United States Patent [19]

Reinehr et al.

[11] 4,185,059

[45] Jan. 22, 1980

[54] PROCESS FOR THE PREPARATION OF HYDROPHILIC FIBRES AND FILAMENTS FROM SYNTHETIC POLYMERS

[75] Inventors: Ulrich Reinehr, Dormagen; Hermann-Josef Jungverdorben, Grevenbroich, both of Fed. Rep. of Germany

[73] Assignee: Bayer Aktiengesellschaft, Leverkusen, Fed. Rep. of Germany

[21] Appl. No.: 775,574

[22] Filed: Mar. 8, 1977

[30] Foreign Application Priority Data

Mar. 10, 1976 [DE] Fed. Rep. of Germany ..... 2609829

[51] Int. Cl.[2] ..... B29H 7/20

[52] U.S. Cl. ..... 264/51; 264/182; 264/184; 264/205; 264/206; 264/211; 428/376

[58] Field of Search ..... 264/182.51, 184, 204–206, 264/41, 49, 211; 428/376

[56] References Cited

U.S. PATENT DOCUMENTS

| | | | |
|---|---|---|---|
| 2,965,437 | 12/1960 | Blumberg | 264/184 |
| 3,318,990 | 5/1967 | Kajitan | 264/188 |
| 3,626,045 | 12/1971 | Woodings | 264/188 |
| 3,773,884 | 11/1973 | Shimosaka et al. | 264/182 |
| 3,833,708 | 9/1974 | Miller et al. | 264/49 |
| 3,896,204 | 7/1975 | Goodman et al. | 264/211 |
| 3,929,946 | 12/1975 | Orito et al. | 264/182 |
| 3,975,478 | 8/1976 | Leonard | 264/41 |
| 4,035,459 | 7/1977 | Kesting | 264/49 |

FOREIGN PATENT DOCUMENTS

| | | | |
|---|---|---|---|
| 40-21465 | 9/1965 | Japan | 264/182 |
| 41-6297 | 4/1966 | Japan | 264/182 |
| 47-15901 | 5/1972 | Japan | 264/182 |

*Primary Examiner*—Jay H. Woo

*Attorney, Agent, or Firm*—Sprung, Felfe, Horn, Lynch & Kramer

[57] ABSTRACT

The invention relates to a process for the production of hydrophilic filaments and fibers which comprises wet- or dry-spinning a fibre-forming synthetic polymer from a spinning solvent containing from 5 to 50% of a substance which has a higher melting or boiling point than the spinning solvent which is miscible with the spinning solvent and with a liquid suitable for use as a washing liquid and which is a non-solvent for the polymer to be spun and from 0,1 to 20% by weight of at least one substance which decomposes into a gas under heating.

9 Claims, No Drawings

PROCESS FOR THE PREPARATION OF HYDROPHILIC FIBRES AND FILAMENTS FROM SYNTHETIC POLYMERS

This invention relates to a process for improving the hydrophilic properties of fibres and filaments obtained from synthetic polymers.

For various purposes, e.g. for bedlinen or underwear, it is desirable to have textiles made of chemical fibres which are similar to natural fibres such as cotton in their response to moisture. There has therefore been no lack of attempts to improve the properties of chemical fibres which are unsatisfactory in this respect.

One such attempt, for example, has consisted of mixing synthetic fibres with very hydrophilic natural fibres. It is also known, for example, that polyacrylonitrile can be mixed with a second acrylonitrile polymer which contains from 30 to 80% by weight of a polyethylene oxide methacrylate followed by spinning the mixture (German Patent Specification No. 1645532). These acrylic fibres, which contain ethoxylated acrylic acid derivatives having chemically bound polyethylene oxide, have already been known for some time on account of their anti-static effect. However, they do not possess exceptionally high moisture absorption capacity. Improving the hydrophilic character by copolymerisation of certain monomers has also been attempted.

According to Japanese Pat. application No. 2782/70, monomers which have a hydrophilic group, e.g. acrylic acid derivatives, are incorporated by polymerisation and then hydrolysed. A specially substituted acrylamide is proposed as comonomer in German Offenlegungsschrift No. 2061213.

Attempts have also been made to improve the hydrophilic character by cross linking. German Auslegeschrift No. 2303893 describes the sulphuric acid hydrolysis of wet spun, swollen acrylic fibres in which the N-methylol compound of an unsaturated amide has been incorporated by polymerisation. Fibres having improved moisture absorption capacity are also obtained by cross linking according to U.S. Pat. Specification No. 3,733,386. In this case, the fibres are treated with aldehyde compounds and acid.

Fibres containing cavities have been disclosed in German Pat. Specification No. 2124473. These fibres are alleged to have hydrophilic properties similar to those of cotton after they have been treated with an agent to improve their hydrophilic character, such as sodium hydroxide solution sulphuric acid or hydroxylamine. Treatment with such agents is not advisable for various reasons, e.g. the resulting problems of corrosion. However, if the fibres are not treated with such agents, their hydrophilic character is unsatisfactory in spite of cavities and the fibres can only be used for a limited range of purposes since they tend to fray and split. The process described in German Patent Specification No. 2124473 is therefore only of limited use for large scale technical production of hydrophilic fibres and filaments.

In spite of the large number and variety of the methods which have been adopted, there has up to now been no success in providing a simple and problem-free process for producing synthetic fibres having a hydrophilic character even approaching that of cotton. The moisture absorption capacity of cotton is about 7% at 21° C. and 65% relative humidity and its water retention capacity is about 45%.

According to an earlier proposal by the present applicants, hydrophilic fibres and filaments can already be obtained by adding, to the solvent used for the polymer in a wet or dry spinning process, from 5 to 50% by weight, based on the quantity of solvent and polymer solid content, of a substance which has a higher boiling point, melting point or sublimation point than the spinning solvant used, which is readily miscible with the spinning solvent and with water or some other liquid, and which is a non-solvent for the polymer to be spun.

By this process it is possible to obtain filaments and fibres with a core and sheath structure which have a moisture absorption capacity of at least 2% (at 65% relative humidity and 21° C.) and a water retention capacity of at least 10%. This means that the hydrophilic properties are almost equal to those of cotton.

It has now surprisingly been found that the hydrophilic character of filaments or fibres can be considerably increased by adding to the spinning solution not only the substance already mentioned above but in addition substances which decompose into gaseous constituents under heating.

It is therefore an object of the present invention to provide such fibres and filaments and a process for producing such fibres and filaments which would be even further improved in their moisture absorption capacity and water retention capacity and would in some cases even be superior to cotton in these respects.

These and other objects which will be evident from the following description and the examples are accomplished by a process for the production of hydrophilic filaments and fibres from fibre forming synthetic polymers by a process for the production of hydrophilic filaments and fibres which comprises wet—or dry—spinning a fibre-forming synthetic polymer from a spinning solvent containing:

(A) from 5 to 50% by weight, based on the solvent and polymer solids content, of a substance which
  (a) has a higher melting or boiling point under normal conditions than the spinning solvent
  (b) is miscible with the spinning solvent and with a liquid suitable for use as a washing liquid, and
  (c) is a non-solvent for the polymer to be spun, and
(B) from 0.1 to 20% by weight, based on the polymer solids content, of at least one substance which decomposes into a gas under heating.

The polymers used for producing the filaments and fibres are preferably acrylonitrile polymers and among these, it is preferred to use those which contain at least 50% by weight of acrylonitrile units.

When acrylonitrile polymers are used, the hydrophilic character of the fibres can be even further increased by adding copolymers which contain comonomers having hydrophilic amino-, sulpho-, hydroxyl-N-methylol or carboxyl groups. Examples of particularly suitable compounds include acrylic acid, methacrylic acid, methallyl sulphonic acid amide, e.g. N-methylol acrylamide and N-methylol methacrylamide. Mixtures of polymers may be used.

The usual solvents used for wet or dry spinning may be used as spinning solvents, e.g. dimethyl acetamide, dimethyl sulphoxide or N-methyl pyrrolidone, but dimethyl formamide is preferred.

The substance described under (A) which is to be added to the spinning solvent must fulfil the following conditions: its melting point or boiling point must, under normal conditions be higher, preferably by 50° C. or more, than that of the solvent; the substance must be miscible, preferably in any portion, with the solvent used as well as with water or any other liquid suitably used as washing liquid: and it must for practical purposes be a non-solvent for the polymer, i.e. it should at the most dissolve the polymer only to a very slight extent.

Substances which fulfil these conditions include, for example, the monosubstituted and poly substituted alkyl ethers and esters of polyhydric alcohols, for example the monomethyl and dimethyl ethers of diethylene glycol, the monoethyl and diethyl ethers of diethylene glycol and the monobutyl and dibutyl ethers of diethylene glycol, diethylene triethylene glycol itself, triethylene glycol, tripropylene glycol,/glycol diacetate, tetraethylene glycol, tetraethylene glycol dimethyl ether, and glycol ether acetates such as butylglycol acetate. High boiling alcohols such as 2-ethylcyclohexanol and esters or ketones or mixtures thereof, e.g mixtures of ethylene glycol acetates, are also suitable.

Glycerol and its homologues are preferably used.

Mixtures may, of course, be used instead of a single substance, provided only that the substances used are soluble in water or some other liquid used as washing liquid, e.g. alcohol, so that they can be removed in the course of the after treatment of the fibres.

It is also advantageous to use substances which do not form azeotropic mixtures with the spinning solvents used and which do not sublime, so that they can be almost completely recovered by fractional distillation, as for example in the case of mixtures of DMF and glycerol or of DMF and diethylene glycol.

These substances are added to the spinning solvent in quantities of from 5 to 50% by weight and preferably from 10 to 20% by weight, based on the quantity of solvent and polymer solid content. The upper limit of the quantity of substance which may be added is in practice determined by the requirement that the polymer solution should still be spinnable. The higher the proportion by weight of substance added to the spinning solvent, the more pronounced will be the porosity in the core of the fibres and the higher will be the hydrophilic character of the filaments produced from such spinning solution mixtures.

Glycerol may be added in quantities of up to about 16% by weight to a 17% by weight solution of polyacrylonitrile in DMF. To ensure thorough mixing of the spinning solution, it is desirable first to mix the spinning solvent, e.g. DMF, with the higher boiling liquid and only then to add the vigorously stirred solution containing polymer powder because precipitation has been observed to take place when glycerol is added directly to solutions of polyacrylonitrile in DMF.

Suitable substances which are decomposed by heat into gaseous constituents such as ammonia, carbon dioxide, sulphur dioxide or nitrogen or into constituents such as water or acetic acid which are gaseous at the temperatures employed include, for example, ammonium acetate, ammonium oxalate, ammonium bicarbonate, ammonium carbonate and ammonium hydrogen sulphite. Ammonium acetate is preferred. In order to obtain a marked increase in the hydrophilic character, it is generally sufficient to add these substances in quantities of from 0.1 to a maximum of 20% by weight, based on the polymer solid content. It is preferred to add from 1 to 10% of the substance which decomposes into gaseous constituents.

Either dry or wet spinning may be employed in the process according to the invention. The dry spinning process is preferred. The choice of substances decomposing into gaseous constituents depends, of course, on the choice of spinning process. Whereas in the dry spinning process the substance would already decompose in the spinning shaft, in the wet spinning process it is necessary to ensure decomposition by the application of heat in one of the after treatment steps.

In order to obtain the greatest possible increase in hydrophilic character in the dry spinning process according to the invention, the spinning should be carried out under such conditions that as little as possible of the added substance, for example glycerol, evaporates during the dry spinning process in the shaft or is carried along by the evaporating spinning solvent.

Since however, gaseous decomposition of the substance added to the solvent mixture, e.g. to DMF+glycerol, is assisted by high temperatures in the spinning shaft, it has been found advantageous to employ spinning shaft temperatures which are at most 80° C., and preferably from 20° to 40° C. above the boiling point of the spinning solvent used.

The fibres and filaments obtained by the process according to the invention have a core and sheath structure. The core is microporous and the average pore diameter is at the most 1$\mu$ and generally between 0.5 and 1$\mu$. When viewed in cross section through the fibre, the surface area of the core generally amounts to about 70% of the total cross sectional surface area.

The sheath may be solid or may also be microporous depending on the choice of after-treatment conditions.

Whereas conventional dry-spun filaments and fibres are dumb bell shaped or bone shaped in cross section, the filaments and fibres according to the invention predominantly have a different cross sectional form. Irregular, trilobate mushroom shaped, circular and kidney bean shaped structures are found, in some cases side by side. The predominant cross sectional form depends on the spinning conditions employed as well as on the quantity of liquid added to the spinning solvent the latter factor having the stronger influence. Filaments and fibres obtained by wet spinning do not have the customary bean shaped, knotched cross-sectional forms but are predominantly circular in section.

In addition to their hydrophilic character already mentioned above, the filaments and fibres according to the invention have good fibre characteristics such as high ultimate tensile strength, elongation on tearing and dye absorption capacity.

Although the description given above has been confined to acrylic fibres and their production, the present invention is not limited to these. It is equally applicable to linear, aromatic polyamides, for example the polyamide of m-phenylene diamine and isophthaloyl chloride or polyamides containing heterocyclic ring systems, e.g. polybenzimidazoles, oxazoles, thiazoles, etc., which can be spun by a wet or dry spinning process.

Determination of the water retention capacity (WR):

The water retention capacity is determined in accordance with DIN specification 53 814 (see Melliand Textilberichte 4 1973, page 350).

The samples of fibres are immersed for two hours in water containing 0.1% of wetting agent. The fibres are then centrifuged for ten minutes at an acceleration of 10,000 m/sec$^2$ and the quantity of water retained in and between the fibres is determined gravimetrically. To determine the dry weight, the fibres are dried to constant weight at 105° C. The water retention capacity (WR) in % by weight is given by the equation:

$$WR = \frac{m_f - m_{tr}}{m_{tr}} \times 100$$

where $m_f$=weight of moist fibre goods, $m_{tr}$=weight of dry fibre goods.

Determination of the moisture absorption capacity (MA):

The moisture absorption of the fibre, based on the dry weight of the fibre, is determined gravimetrically. The samples are exposed for 24 hours to an atmosphere of 21° C. and 65% relative humidity. To determine the dry weight the samples are dried to constant weight at 105° C. The moisture absorption capacity (MA) in % by weight is given by the equation:

$$MA = \frac{m_f - m_{tr}}{m_{tr}} \times 100$$

where $m_f$=weight of moisture of fibre at 21° C. and 65% relative humidity, $m_{tr}$=dry weight of fibre.

The following Examples serve to further explain the invention without limiting it. Parts and percentages refer to weight unless otherwise indicated.

EXAMPLE 1

19.8 kg of DMF, 4.1 kg of glycerol and 0.2 kg of ammonium acetate were mixed in a reaction vessel with stirring. 5.7 kg of an acrylonitrile copolymer of 93.6% of acrylonitrile, 5.7% of methyl acrylate and 0.7% of sodium methallyl sulphonate were then added with stirring. The mixture was stirred at 80° C. for one hour and filtered, and the spinning solution thus obtained was dry spun through a 180 aperture die into a spinning shaft by the methods known in the art.

The temperature of the shaft was 175° C. The viscosity of the spinning solution, which had a solids concentration of 19% and a glycerol content of 14% by weight, based on DMF+polyacrylonitrile powder, was 65 falling ball seconds. The proportion of the substance which decomposes into gaseous constituents was 3.5% by weight, based on the dry weight of acrylonitrile polymer.

For determination of the viscosity by the falling ball method, see K. Jost Rheologica Acta, Volume 1, No. 2-3 (1958), page 303. The spun product, having a titre of 3470 dtex, was collected on spools and doubled to form a spinning band having a total titre of 104'100 dtex. On leaving the spinning shaft, the spinning band still contained 12.3% by weight of glycerol.

The glycerol content in the spinning band was determined by gas chromatographic analysis. The fibre cable was then stretched in a ratio of 1:3:6 in boiling water, washed in boiling water for 3 minutes under a light tension and then treated with an anti-static dressing. It was dried in a sieve drum dryer at 140° C. under conditions permitting 20% shrinkage and cut up into staple fibres 60 mm in length.

The individual filaments had a final titre of 6.7 dtex, a moisture absorption capacity of 3.2% and a water retention capacity of 84%.

Ultimate tensile strength: 2.3 p/dtex; elongation on tearing 40%.

On leaving the spinning shaft, the fibres had a pronounced core and sheath structure with irregular, mostly trilobate cross section.

The width of the sheath in cross section was about 4 μm. More than 100 fibre cross sections were quantitatively analysed to determine the ratio of core to sheath in the fibres. According to these measurements on average 32% of the cross-sectional area of the fibre consists of sheath.

The proportion of residual solvent in the fibre was less than 0.2% by weight and the proportion of glycerol left in the fibre was 0.6% by weight. The fibres could be deep dyed to an intense shade with a blue dye having the formula:

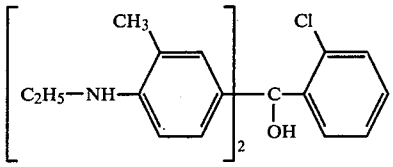

The extinction was 1.31 for 100 mg of fibre per 100 ml of DMF (570 mμ, 1 cm cuvette).

EXAMPLE 2

Acrylonitrile copolymer having a chemical composition analogous to that described in Example 1 was dissolved under the same conditions in a mixture of DMF and glycerol, but the proportion of ammonium acetate was increased to 0.4 kg, corresponding to 7.0% by the weight, based on the polymer powder. The solution was filtered and spun. The spun material was collected on spools and doubled to form a band having a total titre of 104'100 dtex.

The material was then after-treated as described in Example 1.

The filaments had an individual titre of 6.7 dtex and a moisture absorption capacity of 2.3%. The water retention capacity was 106%.

The fibres had a pronounced core and sheath structure with irregular, mostly trilobate cross section.

EXAMPLE 3 (COMPARISON)

An acrylonitrile copolymer analogous in chemical composition to that of Example 1 was dry spun under the same conditions from a mixture of DMF and glycerol but without the addition of ammonium acetate, and the fibres were after-treated as described in Example 1.

The fibres had a final titre of 6.7 dtex, a moisture absorption capacity of 2.9% and a water retention capacity of 64%. Fibre cross section: core and sheath structure with trilobate form. This shows that, without the addition of substances which decompose into gaseous constituents, the fibres obtained are much less hydrophilic.

What is claimed is:

1. A process for the production of hydrophilic filaments and fibers having a sheath-core structure and a microporous core which comprises spinning a fiber-forming wet or dry spinnable synthetic polymer as a composition containing, in addition to the spinning solvent:

(A) from 10 to 50% by weight, based on the spinning solvent and polymer solids content, of non-solvent for the polymer to be spun, which non-solvent
(a) has a higher melting or boiling point under normal conditions than the spinning solvent,
(b) is miscible with the spinning solvent and with a liquid suitable for use as a washing liquid, and
(B) from 0.1 to 20% by weight, based on the polymer solids content, of at least one gas former which decomposes into a gas under heating; and washing said non-solvent from said filaments or fibers; in which said fibers or filaments are subjected to a temperature above the decomposition temperature of the gas former during spinning or in a subsequent treatment step.

2. The process of claim 1, wherein said polymer is an acrylonitrile polymer.

3. The process of claim 2, wherein said acrylonitrile polymer comprises at least 50% by weight of acrylonitrile units.

4. The process of claim 1, wherein said gas former which decomposes into a gas is an ammonium salt.

5. The process of claim 4, wherein said ammonium salt is ammonium acetate.

6. The process of claim 1, wherein the spinning solvent contains from 0.1 to 10% by weight of (B) based on the polymer solids content.

7. The process of claim 1 wherein the spinning solvent contains from 10 to 20% by weight of (A), based on the weight of solvent and polymer solids content.

8. The process of claim 1 wherein (A) is glycerol or a homologue thereof.

9. The process of claim 1 in which the hydrophilic filament formed has an average pore size of one micron in the microporous core.

* * * * *